United States Patent [19]

Jamieson

[11] 4,014,352

[45] Mar. 29, 1977

[54] APPARATUS FOR AUTOMATICALLY CONTROLLING THE INITIATION AND/OR TERMINATION OF FUNCTIONS OF APPARATUS OR PROCESSES USING A CLOCK PULSE GENERATOR

[75] Inventor: Patrick J. Jamieson, Bramalea, Canada

[73] Assignee: Rothmans of Pall Mall Canada Limited, Toronto, Canada

[22] Filed: May 2, 1975

[21] Appl. No.: 573,918

Related U.S. Application Data

[62] Division of Ser. No. 504,549, Sept. 9, 1974, Pat. No. 3,911,331.

[52] U.S. Cl. ..... 131/21 R; 131/94; 235/151.1; 328/75; 328/131

[51] Int. Cl.[2] ..... A24B 7/14; A24C 5/32; A24C 5/34

[58] Field of Search ..... 328/72–75, 328/129–131; 131/21 R, 94; 235/151.1

[56] References Cited

UNITED STATES PATENTS

| | | | |
|---|---|---|---|
| 3,067,754 | 12/1962 | Pinkham et al. | 131/21 R |
| 3,672,373 | 6/1972 | Dogl et al. | 131/21 R |
| 3,793,512 | 2/1974 | Lorenzen | 235/151.13 |
| 3,889,240 | 6/1975 | Buchegger | 131/21 R |

*Primary Examiner*—Stanley D. Miller, Jr.
*Attorney, Agent, or Firm*—Sim & McBurney

[57] ABSTRACT

Methods and apparatus are disclosed for controlling the initiation or termination of at least one function in timed relationship to the occurrence of an event. The invention is particularly useful in conjunction with the operation of a cigarette making machine, for example, where it is desired that the supply of cork-tipped paper and filter plugs, for example, be held off after the machine has started until such time as they are in fact required to be introduced in order to make the finished cigarette. A clock pulse generator provides a train of clock pulses which occur one after the other in sequential, spaced apart relationship. The clock pulse generator is activated in response to the occurrence of an event. Means are provided having a plurality of output terminals that translate the train of clock pulses into a plurality of pulse signals derivable from individual ones of the output terminals, one such pulse signal being derivable at each of the output terminals, and the pulses of different ones of the pulse signals occurring at different points in time. At least one network is connectable or is connected to at least one of the output terminals and includes a two state device which controls the initiation or termination of and initiates or terminates the function when the state thereof changes from one state to a second state. The network is responsive to the occurrence of a pulse at the output terminal to which the network is connected for changing the state of the two state device from its one state to its second state thereof.

18 Claims, 37 Drawing Figures

31
35
37
38
43
44
45
46
50
51
52
53
54
55
56
57
58
59
60
61
62
63
64
65
69
105

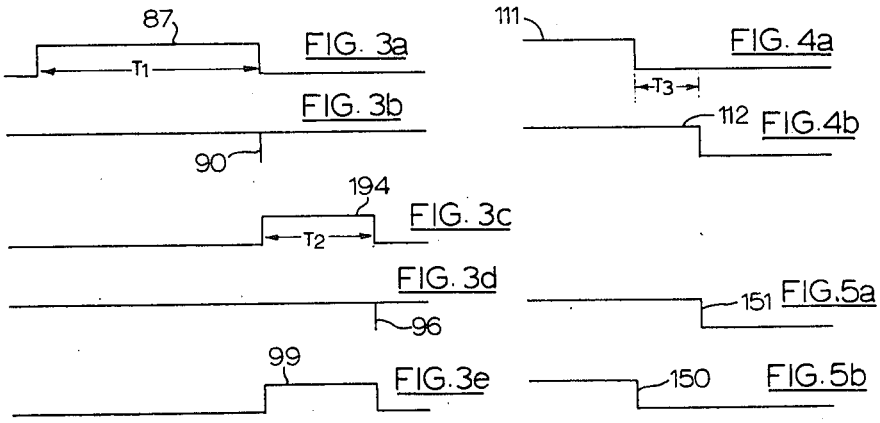
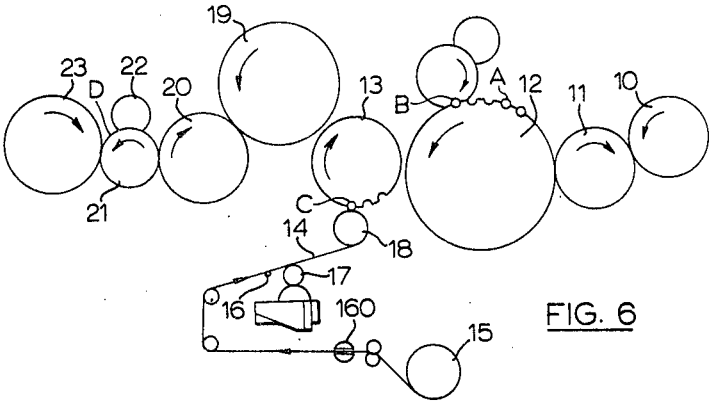
FIG. 6

APPARATUS FOR AUTOMATICALLY CONTROLLING THE INITIATION AND/OR TERMINATION OF FUNCTIONS OF APPARATUS OR PROCESSES USING A CLOCK PULSE GENERATOR

BACKGROUND OF THE INVENTION

This application is a division of U.S. Pat. Application Ser. No. 504,549 filed Sept. 9, 1974 and issued as U.S. Pat. No. 3,911,331 on Oct. 7, 1975.

This invention relates to methods and apparatus for controlling the initiation and/or cessation in timed relation to each other of various functions to be or being performed in or by an apparatus or process. More specifically, and in a preferred embodiment, this invention relates to such methods and apparatus wherein the timed relation may be varied at will and/or wherein one or more of the functions may be included or excluded at will.

The instant invention was conceived as an automatic stop/start system for a Mark VIII cigarette making machine manufactured by Molins and a Hauni Mark III max, and it will be described herein in such an environment. It is to be clearly understood, however, that this is an example of only one use to which the instant invention may be put, and those skilled in the art will appreciate, after consideration of this disclosure, that the invention is applicable to the control of any process or apparatus involving multiple functions that desirably should start or stop in some sequence.

When a conventional Mark VIII machine and Mark III max are started up, paper and tobacco are fed into the maker and filter plugs and cork tip paper are fed into the max, this being the part of the machine where the plugs and cork tip paper are assembled with the previously made untipped cigarette. All of these functions are initiated simultaneously, and yet it takes a finite length of time for cigarettes from the maker to reach the hopper drum of the max, where the plugs are added, and a further length of time for the cigarettes and plugs to move to the assembly drum, where the cork tip paper is applied. As a consequence, each time the machine is started both plugs and cork tip paper are wasted.

Similarly, after the machine has been stopped, it is necessary, on start-up to reject many of the cigarettes that were in the process of being made at the time the machine stopped. For example, cigarettes that were left on the wrapping drum will have dried out and must be scrapped. Cigarettes under the slitter knife will have "browned" ends and also will have to be scrapped. Consequently, cigarette paper, plugs, cork tip paper and tobacco are wasted, although the latter may be recovered at some expense.

The machine starts at low speed and then, if operating satisfactorily, is placed in a high speed mode making about 2000 cigarettes per minute. The transition from low to high speed occurs very quickly and results in a phenomenon known as "moving print." The acceleration of the machine stretches the cigarette paper distorting the manufacturers trade mark that is printed on the paper, and the distorted print is referred to as "moving print." Cigarettes with moving print do not meet quality control standards and must be rejected. At the present time this is achieved by the operator simply guessing the point in time when cigarettes with moving print will reach the inspection drum, as well as for how long such cigarettes will be present on the inspection drum, and manually activating the equipment which rejects cigarettes on the inspection drum at this point in time and for the period of time that the operator thinks is required. Obviously with such a crude form of control, sometimes cigarettes with moving print will not be rejected, which is undesirable from a quality control point of view, while, at other times, cigarettes without moving print will be rejected, which is unnecessary waste.

It is common practice to splice cork tip paper in order to avoid having to thread it through the machine each time a new roll is to be used. Tape is used to effect the splice, and the cigarette or cigarettes to which cork tip paper carrying this tape are applied must be rejected. This is done in the same way as moving print cigarettes are rejected, namely by the operator who attempts to ensure that the one or two such cigarettes bearing tape are rejected by rejecting not only these cigarettes but acceptable ones on both sides thereof. This results in additional waste.

When either a rod break-out or a chimney-choke occurs, it must be noticed by the operator who must then operate the emergency machine stop button. This all requires a certain amount of time during which wastage occurs.

SUMMARY OF THE INVENTION

In accordance with this invention in its broad concept there are provided methods and apparatus for controlling the initiation and/or cessation of multiple functions to be or being performed in or by an apparatus or process such that these various functions commence or stop in a desired relationship to each other to obtain a desired result which may be, for example, reduction of waste.

Looked at in the environment of a cigarette machine, methods and apparatus are provided for delaying the introduction of plugs and/or cork tip paper into the applicable work station of the machine until shortly before they are required, rather than as soon as the machine is started, thus reducing wastage of plugs and cork tip paper.

In a preferred embodiment a delayed stop of the machine is possible, so that the machine is cleared of all cigarettes before it shuts down, again resulting in reduced wastage, but this time of tobacco, cigarette paper, plugs and cork tip paper.

In another preferred embodiment cigarettes with moving print are automatically rejected with none or only a few acceptable cigarettes, again reducing wastage.

In yet another preferred embodiment "cork spliced" cigarettes are automatically rejected with none or only a few acceptable cigarettes, again reducing wastage.

In yet another preferred embodiment, upon occurrence of a rod break-out, chimney choke or pad jam, the machine automatically stops immediately to reduce wastage.

Of course, in the most preferred embodiment all of the foregoing advantages are obtained.

BRIEF DESCRIPTION OF THE DRAWINGS

FIGS. 2*a*-2*y*, 3*a*-3*e*, 4*a* and 4*b*, and 5*a* and 5*b* are timing diagrams, with volts on the vertical axis and time on the horizontal axis, useful in describing the operation of the system shown in FIG. 1; and FIG. 6 is a schematic side view of a Hauni Mark III max.

DETAILED DESCRIPTION OF INVENTION INCLUDING PREFERRED EMBODIMENT

Figure 1A:
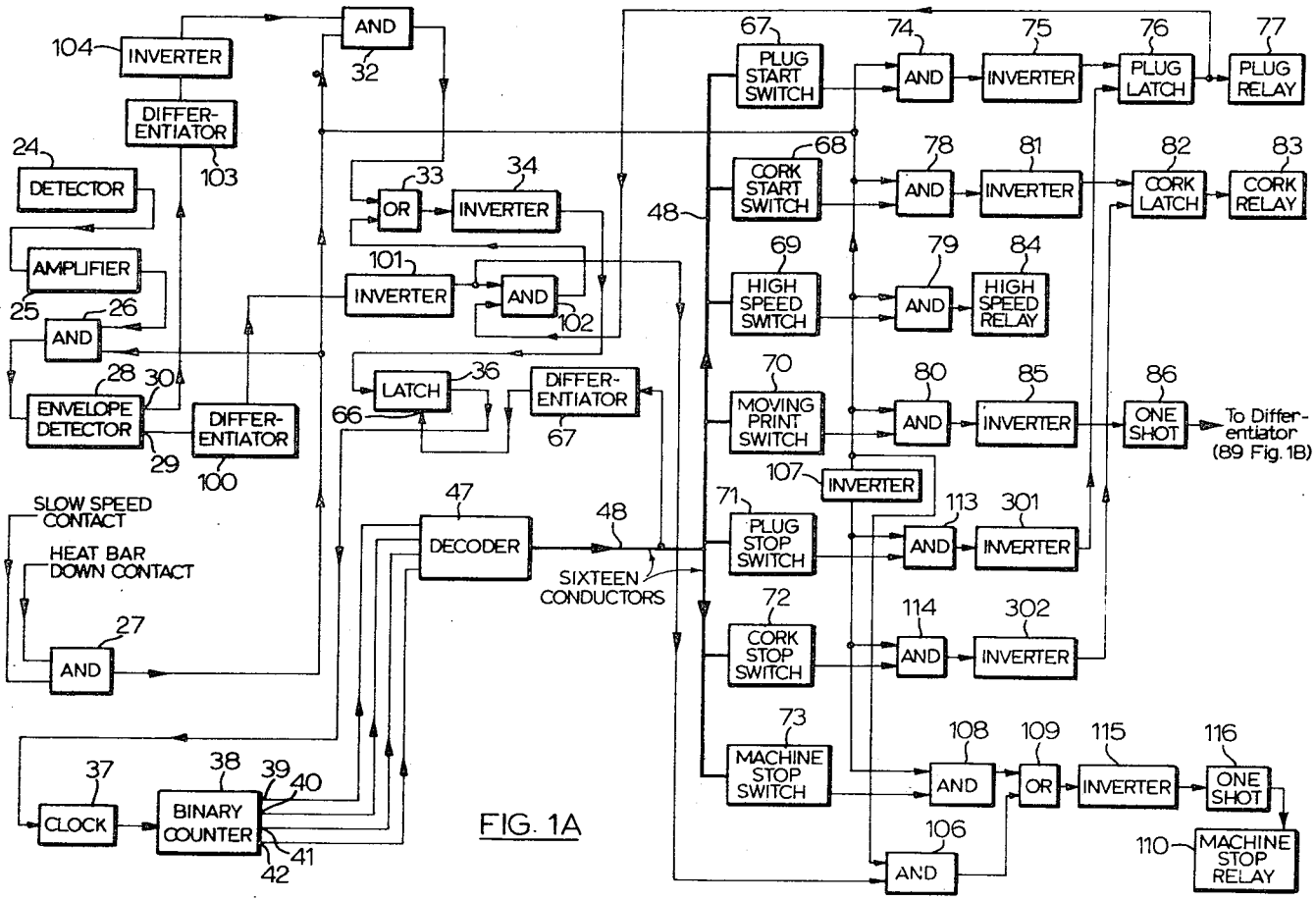
FIG. 1*a* and 1*b* are a block diagram of the most preferred embodiment of this invention for use in controlling a cigarette machine.

Referring to FIG. 6, only the max portion of the machine is shown, and as this is a well known and commercially available machine, no detailed description of it is necessary. In brief, in the maker portion (not shown) of the machine cigarette paper and tobacco are formed into a continuous rod with the adhesive on the paper being sealed by passage under a heater bar. The rod then is cut, while moving, into individual cigarette lengths and these are fed onto fluted drum 10. The untipped cigarettes are transferred to grading drum 11 and then to hopper drum 12. Plugs are also fed onto hopper drum 12 at point B. The cigarettes and plugs are transferred to assembly drum 13 where cork tip paper 14 is added. The cork tip paper is unwound from a reel 15 thereof and passes over lifting arm 16. When the latter is in its down position, the cork tip paper is brought into contact with a glue roller 17 that applies glue thereto. The glued cork tip paper then passes over cork drum 18. The untipped cigarettes, plugs and cork tip paper are assembled on wrapping drum 19 into double length cigarettes which are transferred to inspection drum 20 where unsatisfactory ones are rejected. The accepted double length cigarettes are transferred to slitter drum 21 where they are slit by slitter knife 22. One row of finished cigarretes then are turned end for end on turnover drum 23, so that all of the tipped ends are side-by-side, and the cigarettes subsequently are discharged from the machine.

As indicated previously, the instant invention is not confined to the control of a cigarette machine, and the foregoing and subsequent description where the invention is described in the environment of a cigarette machine is to be construed as merely one example of the utility of the invention.

The system now to be described operates using binary logic. In any such system there are two types of outputs and inputs which generally are high and low voltage levels. The high level commonly is referred to as a 1 output, while the low level is referred to as 0 output. Such terminology will be employed herein.

Figure 1B:
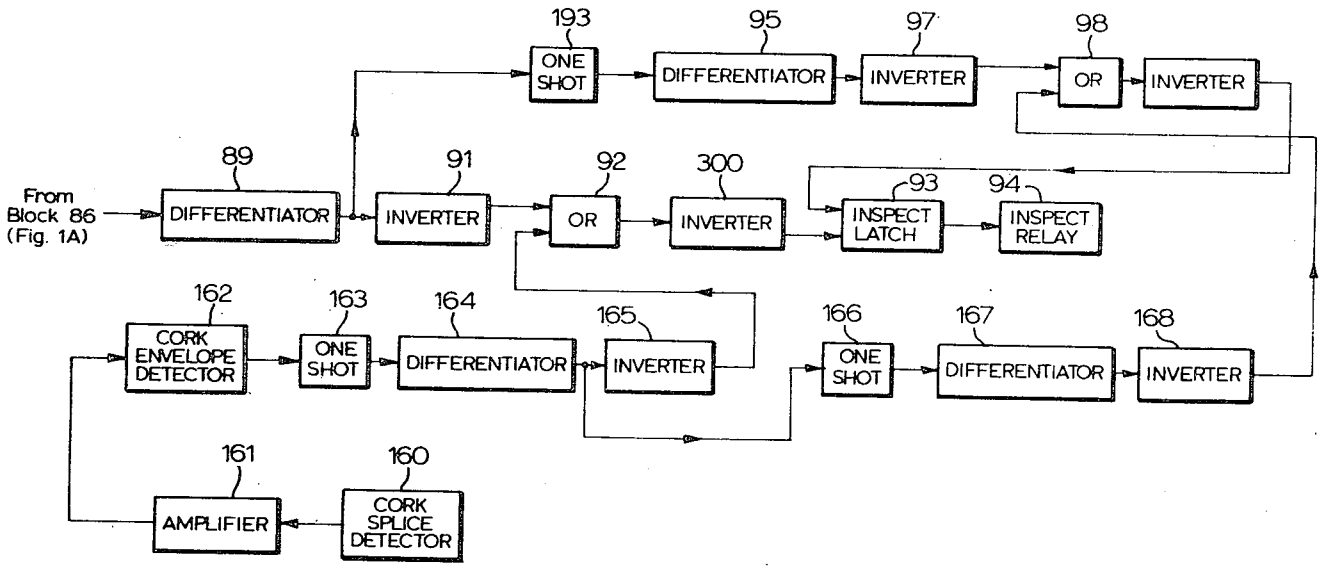

Referring to FIG. 1, there is shown a detector 24. This detector preferbly is of the infra-red type. It is located just ahead of the kicker of the maker, the kicker being the device that "kicks" the cut cigarette lengths onto fluted drum 10. Detector 24 senses the gaps between adjacent cigarettes and provides a pulse each time a gap is sensed. These pulses are amplified by an amplifier 25 that provides a 1 output for each gap but otherwise has a 0 output. The output of amplifier 25 is supplied to one input terminal of an AND gate 26. The other input terminal of this gate is connected to the output terminal of an AND gate 27. The two input terminals of AND gate 27 are connected to the slow speed contacts of the cigarette machine and to contacts on the heater bar of the machine.

Figures 2A, 2B, 2C, 2D, 2E, 2F, 2G, 2H, 2I, 2J, 2K, 2L, 2M, 2N, 2O, 2P, 2Q, 2R, 2S, 2T, 2U, 2V, 2W, 2X, 2Y:
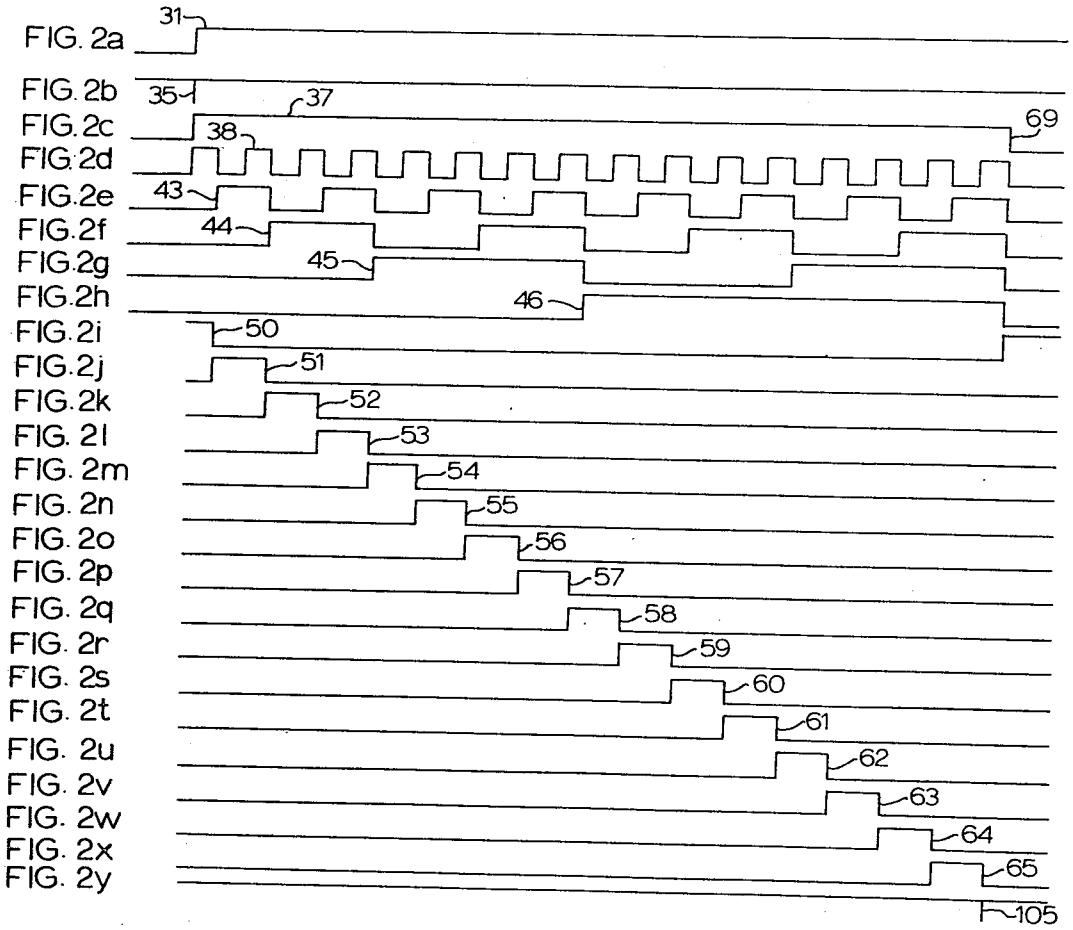

To start up the machine, the slow speed contacts are closed and the heater bar is brought down closing its contacts. Closing the slot speed contacts applies a 1 input to AND gate 27, as does bringing down the heater bar. AND gate 27 thus has a continuous 1 output that is supplied to AND gate 26 where it is ANDed with the signal from amplifier 25. Thus, while cigarettes are being made, the output of AND gate 26 varies between 1 and 0, and is supplied to the input terminal of an envelope detector 28. Envelope detector 28 provides a continuous 1 output at its output terminal 29 and a continuous 0 output at its output terminal 30 provided that 1 inputs are received at its input terminal within predetermined time intervals. The time intervals are selected such that as long as the maker is functioning properly, there will be 1 inputs (representative of the gaps between adjacent cigarettes) supplied to envelope detector 28 in sufficient time to reset the envelope detector so that its outputs at terminals 29 and 30 continuously remain 1 and 0 respectively. The output signal at terminal 29 is shown in FIG. 2*a* at 31. The output signal at terminal 30 is the opposite thereof.

Output terminal 30 is connected to one input terminal of a differentiator 103 that provides a 0 output pulse when the output at terminal 30 changes from 1 to 0. This 0 output pulse is inverted by an invertor 104 and the resultant 1 output pulse thereof is supplied to an AND gate 32 which receives the 1 input pulse from inverter 104 and a continuous 1 input from AND gate 27 and provides a 1 output pulse that is supplied to one input terminal of an OR gate 33. At this time, as will become more apparent hereinafter, the input to the other terminal of OR gate 33 is 0 and the resultant 1 output pulse of OR gate 33 is supplied to an inverter 34 that provides a 0 output pulse that is shown in FIG. 2*b* at 35. This 0 output pulse triggers a latch 36 which provides a 1 output that is shown in FIG. 2*c* at 37. The 1 output of latch 36 is supplied to the input terminal of and initiates operation of a clock 37. Clock 37 counts for as long as the latch is set and produces the regularly spaced 1 outputs shown at 38 in FIG. 2*d*.

The clock output is supplied to the input terminal of a 4-bit binary counter 38 having four output terminals 39-42 at which the outputs shown in FIGS. 2*e*-2*h* at 43-46 respectively are obtained. These outputs are supplied to the four input terminals of a 4-16 decoder 47 that has sixteen output terminals. These output terminals are connected to sixteen conductors 48, one output terminal to each conductor.

The outputs of decoder 47 are shown at 50-65 in FIGS. 2*i*-2*x* respectively. One of the sixteen conductors, specifically the one that carries output 65, is connected to the input terminal of a differentiator 67 that provides a 0 output pulse when output 65 changes from 1 to 0. This is shown at 105 in FIG. 2*y*. This pulse resets latch 36, as shown at 69 in FIG. 2*c*, and the consequent 0 input to clock 37 terminates the count.

Shown in FIG. 1 are seven switches 67-73 that are labelled plug start switch, cork start switch, high speed switch, moving print switch, plug stop switch, cork stop switch and machine stop switch respectively. Each of these switches is a manually operated switch having a rotary contact and then fixed contacts each of which can be engaged by the rotary contact to close a circuit. One fixed contact of each switch is grounded, this corresponding to a 0 input. The other fixed contacts of the switches are connected to various ones of the sixteen conductors 48. Which of these conductors is selected to be connected to the fixed contacts of any switch 67-73 depends upon the function that is performed by this switch. Thus, in the present case, after the cigarette machine has started up and is operating on slow speed, the first function that it is desired to initiate is the bringing in of plugs to the max. Consequently the remaining nine fixed contacts of switch 67 should be connected to those conductors 48 having 1 outputs early on in the count of clock 37, for example, outputs 52-60. The next function that it is desired to initiate is the feeding of cork tip paper to assembly drum 13. Thus the remaining nine fixed contacts of switch 68 may be connected to those conductors 48 having outputs 53-61, for example. High speed operation and rejection of moving print cigarettes are functions which are initiated later on in the cycle, so the remaining nine fixed contacts of switches 69 and 70 may be connected to those of conductors 48 carrying outputs 57-65 for example.

During a normal shut-down of the machine the supply of plugs should be interrupted after the last cigarette length on fluted drum 10 has passed the point at which plugs are added to hopper drum 12. Subsequently the supply of cork tip paper 14 to assembly drum 13 should be stopped, and then the whole machine should be shut down after the last double length cigarette has passed slitter knife 22. Thus the remaining nine fixed contacts of switches 71-73 may be connected to those of conductors 48 having outputs 52-60, 53-61 and 57-65, for example.

In any event, it should be apparent from the foregoing that depending on the connections of conductors 48 to the remaining nine fixed contacts of each of switches 67-73 and the setting of the rotary contacts of these switches, any one of outputs 50-65 can be supplied to and through any one of switches 67-73 to activate the circuitry that follows these switches and to initiate or terminate the machine function controlled by such circuitry. As each output 50-65 occurs at a different point in time, it is thus possible to cause these various functions to initiate or terminate at different times with respect to each other, and it is also possible, by varying the position of the rotary contacts of any of the switches, to cause the point in time at which the function controlled by that switch is initiated or terminated to be advanced or retarded. It was mentioned that one fixed contact of each switch may be grounded, corresponding to a 0 input. This provides the facility for inhibiting the function controlled by the switch, as will become more apparent hereafter, simply by turning the rotary contact thereof to the position where it makes an electrical connection with this fixed contact. In this way, for example, high speed operation can be inhibited.

For purposes of discussion it will be assumed that the rotary contact of plug start switch 67 is connected to the fixed contact thereof that in turn is connected to the one of conductors 48 that is carrying output 53. This 1 output and the 1 output of AND gate 27 are supplied to the two input terminals of an AND gate 74. The resultant 1 output thereof is inverted by an inverter 75 and the change in output thereof from 1 to 0 sets a plug latch 76. The 1 output of plug latch 76 operates a plug relay 77 that activates another plug relay (not shown) that is a part of the max and which, when activated, causes plugs to be supplied to hopper drum 12. The point in time at which the supply of plugs is commenced depends upon the time location of output 53 and desirably is chosen such that plugs are not fed into the max until the first cigarette reaches point A in FIG. 6. Obviously if the plugs are being fed earlier or later than is desired, the rotary contact of plug start switch 67 should be moved to select a later output such as 54 or 55 or an earlier output such as 51 or 52.

The presence of AND gate 74 is an extra precaution. One of the inputs thereto, namely the one from AND gate 27, indicates that the heater bar is down. The other input to AND gate 74 also indirectly indicates this, since clock 37 would not otherwise commence its count. However, since spurious pulses might trigger the clock, the presence of AND gate 74 and the fact that one of its inputs is a heater bar down signal, ensures that the function controlled by plug start switch 67 will not be initiated unless the heater bar is in fact down. AND gates 78, 79 and 80 are for the same purpose with respect to the functions controlled by switches 68–70 respectively.

The next function to be initiated is the supply of cork tip paper 14. This desirably should start when the first plug reaches point C in FIG. 6 and, to this end, cork start switch 68 should have its rotary contact moved to select the appropriate one of the ouputs 50–65. This will be an output that occurs after output 53, i.e., the output that is responsible for activation of relay 77, and may be output 55, for example. If this occurs too soon, a later output such as 56 may be chosen or, if too early, output 54 may be selected. Output 55 is ANDed with the 1 output of AND gate 27 in AND gate 78, the resultant 1 output thereof is inverted by an inverter 81 and the resultant change in output thereof from a 1 output of a 0 output sets a cork latch 82. Like plug latch 76, cork latch 82 provides a 1 output until it is reset, and this activates a cork relay 83. The latter activates a cork relay (not shown) that is a part of the max and which, when activated, causes cork tip paper 14 to be supplied to the max and lifting arm 16 to drop so as to permit adhesive to be applied to the cork tip paper.

The next function to be sequentially initiated is high speed operation. The latter is to commence after the plugs are in and the cork tip paper is running. Thus the rotary contact of high speed switch 69 may be moved to select output 58, for example. When this 1 output occurs, it is ANDed with the 1 output of AND gate 27 in AND gate 79 and the resultant 1 output of AND gate 79 activates a high speed relay which, in turn, activates a self-latching high speed relay (not shown) that is a part of the cigarette machine and that causes the machine to shift from low to high speed operation. The machine high speed relay is self-latching, as previously noted, and remains activated until the machine stop relay 110 is activated, about which more will be said later.

The final function to be performed in the start-up sequence is the rejection of moving print cigarettes. It will be recalled that these are produced when the machine switches from low to high speed operation. As it takes these cigarettes a certain length of time to travel from the maker to inspection drum 20, moving print switch 70 should be set to select an output from decoder 47 which occurs after the output that causes high speed operation and after a time interval equal to the length of time required to move the first moving print cigarette from the maker to inspection drum 20. In addition, the rejection function has to be performed long enough to ensure that all moving print cigarettes are rejected, but preferably no longer. Neglecting the latter facet, it might be possible to perform the former function using simply an AND gate, interver, inspection latch and inspection relay, but it may be found that even the last output 65 occurs too early in time for initiation of the function. When this is the case, as it will be assumed to be, certain additional components may be provided to achieve the desired objective. It will be assumed, for purposes of description, that the rotary contact of moving print switch 70 is moved to select output 65. When this 1 output occurs, it is ANDed with the 1 output of AND gate 27 in AND gate 80. The resultant 1 output of the latter is inverted in an inverter 85 and the change in state from 1 to 0 output thereof triggers a one shot flip-flop 86. The output of flip-flop 86 is shown at 87 in FIG. 3*a*. Triggering of the flip-flop occurs at the transition of pulse 87 from 0 to 1. The duration of time $T_1$ that the flip-flop provides a 1 output is variable and is preset. Time $T_1$ plus the length of time from the commencement of the count of clock 37 until output 65 is received by moving print switch 70 is the length of time for the first moving print cigarette to reach inspection drum 20. At the end of time $T_1$ the output of one shot 86 drops to 0. The output of one shot 86 is supplied to a differentiator 89 that always provides a 1 output until the output of one shot 86 changes from 1 to 0. At this point in time differentiator 89 provides a 0 output pulse, as shown at 90 in FIG. 3*b*. This is inverted by an inverter 91, and the resultant 1 input pulse is supplied to one input terminal of an OR gate 92. The resultant 1 output pulse of OR gate 92 is inverted by an inverter 300 that sets an inspection latch 93, and the resultant 1 output thereof activates an inspection relay 94. The latter activates an inspection relay (not shown) that is part of the max and which, when activated, causes cigarettes on the inspection drum to be rejected.

The output of differentiator 89 is supplied to the input terminal of another one shot 193 which is triggered when the output of the differentiator goes to 0, as shown at 90 in FIG. 3*b*. The output of one shot 193 is shown at 194 in FIG. 3*c*. The period of time $T_2$ that the output of one shot 193 is 1 is variable and is preset. Time $T_2$ should be long enough to ensure the rejection of all moving print cigarettes. The output of one shot 193 is supplied to the input terminal of a differentiator 95 that normally provides a 1 output but which provides a 0 output pulse, as shown at 96 in FIG. 3*d*, when the output of one shot 193 changes to 1 to 0. This 0 output pulse is inverted by an inverter 97 and the resultant 1 output pulse is supplied to one input terminal of an OR gate 98. The 1 output pulse thereof is inverted by an inverter 203 and the output thereof is supplied to the reset terminal of inspection latch 93, the transistion from 1 to 0 resetting the latch which, in turn, deenergizes inspection relay 94 and the machine inspection relay causes the rejection of cigarettes on the inspection drum to terminate. The output of latch 93 is shown at 99 in FIG. 3*e*.

It should be understood that the technique of employing a one shot and a differentiator or equivalent devices may be employed to control the initiation and/or the termination of other machine or process functions where a longer time delay than it is possible to obtain with the maximum count of clock 37 is required.

It also should be understood that the outputs of decoder 47 that were selected in the previous description (and which will be selected in the subsequent description of the machine stopping procedure) are exemplary only. The ones that actually will be selected will depend on the machine or process being controlled and will be influenced by such factors as speed of operation and the time taken for an article being processed to move from one work station to another.

To complete the start-up description, although it really performs no start-up function, the 1 output at output terminal 29 of envelope detector 28 is supplied to a differentiator 100. The output of differentiator 100 is 1 except when the input thereto changes from 1 to 0, when a 0 pulse output results. The 1 output of differentiator 100 is inverted by an inverter 101. The resultant 0 output of the inverter is supplied to one input terminal of an AND gate 102. At this time plug latch 76 has not been set, so a 0 input is supplied to the other input terminal of AND gate 102 resulting in a 0 ouput frm AND gate 102. This 0 ouput is supplied to one of input terminals of OR gate 33, but, at the same time, a 1 input pulse is being supplied to its other input terminal, as previously noted herein, to provide the necessary 1 output pulse from OR gate 33 to set latch 36. It will be noted that even when plug latch 76 is set, there will be no change in the output of AND gate 102. The 0 output of inverter 101 also is supplied to one input terminal of an AND gate 106. This 1 output of AND gate 27 is supplied to the other input terminal of AND gate 106. Thus the output thereof is 0. Even if there should be a 1 output from machine stop switch 73, this being supplied to one input terminal of an AND gate 108, a 0 input is supplied to the other input terminal thereof from inverter 107. Consequently AND gate 108 provides a 0 output and this, coupled with the 0 input from AND gate 106, results in a 0 output from an OR gate 109 to the two input terminals of which the outputs of AND gates 106 and 108 are connected. As a consequence of there being no change in the output of OR gate 109 from its normal 0 output, activation of the machine stop relay 110 which, when activated, activates a machine stop relay that is a part of the cigarette machine and which causes it to shut down when activated, does not take place.

In order to shut the machine down on a delayed stop basis a delayed stop push button (not shown) is depressed. When this has been done, the electromagnet holding the heater bar down is deenergized and the heater bar rises causing the output of AND gate 27 to change fom 1 to 0. This is shown at 111 in FIG. 4*a*. Once the heater bar has risen, cigarettes no longer will be made, so the output of detector 24 will be a continuous 0 or a continuous 1 depending on wheter or not a cigarette remains in the machine under the detector. Regardless of the output of detector 24, since one input to AND gate 26 is 0, as previously explained, the output of AND gate 26 will be 0 causing a 1 output at terminal 30 of envelope detector 28 and a 0 output at terminal 29 thereof. The output at terminal 29 is shown at 112 in FIG. 4*b*. The output at terminal 30 is the opposite. The time delay $T_3$ (FIG. 4*a*) is due to the inherent time delay (time constant) of the envelope detector.

As the input from the AND gate 27 to AND gate 32 now is 0, the output thereof changes to 0, and this will not provide the necessary 1 input to one of the two terminals of OR gate 33 that is required to set latch 36. However, the previous 1 output at terminal 29 has changed to a 0 output, so that output of differentiator 100 is a 0 pulse, and the output of inverter 101 is a 1 output pulse. This coupled with the other 1 input to AND gate 102 from plug latch 76 results in a 1 output pulse from AND gate 102. This is supplied to the other terminal of OR gate 33 resulting in a 1 output pulse that is inverted by inverter 34. Latch 36 thus is set again and clock 37 and decoder 38 function as before. However, this time all of AND gates 74-80 are inhibited by the 0 ouput of AND gate 27. The output of inverter 107, on the other hand, changes from 0 to 1, and this output is supplied to one input terminal of each of AND gates 113, 114 and 108.

In shutting down the machine it is desired for the plugs to stop immediately after the last cigarette has reached point B (FIG. 6). Supply of cork tip paper should stop and lifting arm 16 should rise immediately after the last cigarette reaches point C. After the last cigarette has passed point D, the remainder of the machine should be stopped.

The fixed contacts of switches 71–73 are connected to appropriate ones of conductors 48 such that by appropriate setting of the rotary contacts thereof the foregong objectives can be obtained. Thus switch 71 will be set to select an early one of outputs 50–65, switch 72 will be set to select a later occurring one of these outputs and switch 73 will be set to select even a later occurring one of the outputs.

When the selected output is received by plug stop switch 71, it is supplied to AND gate 113 where it is ANDed with the 1 output of inverter 107. The resultant 1 output of AND gate 113 is inverted by an inverter 301. The resultant 0 output thereof is supplied to the reset terminal of plug latch 76 and the transition from 1 to 0 resets this latch. The resultant output of latch 76 deenergizes plug relay 77, which deenergizes the machine plug relay causing the supply of plugs to be interrupted.

Similarly, but at a later point in time, the output of decoder 47 that is selected by cork stop switch 72 is ANDed in AND gate 115 with the 1 output of inverter 107, and the resultant 1 output is inverted by an inverter 302 that resets cork latch 82 and deenerigzes cork relay 83. This results in the machine cork relay being deenergized to terminate the supply of cork tip paper 14 to the max and to cause the lifting arm 16 to rise.

Finally, and at an even later point of time, the output of decoder 47 that is selected by machine stop switch 73 is ANDed in AND gate 108 with the 1 output of inverter 107. The resultant 1 output of AND gate 108 is supplied to one terminal of OR gate 109. At this time there is a 0 input to the other input terminal of OR gate 109, as will be explained later. The resultant 1 output of OR gate 109 is inverted by an inverter 115. The change in state of the output of inverter 115 from 1 to 0 triggers a one shot 116 whose output goes from 0 to 1 and is supplied to machine stop relay 110. During the time that the output of one shot 116 is 1, machine stop relay is energized and its contacts are kept open to ensure complete interruption of power to the machine stop relay in the machine. These contacts close again when the output of one shot 116 reverts to 0, but before the machine can be started again, the slow speed contacts must be closed. This is because the machine stop relay in the machine is interlocked with the slow speed contacts and with the high speed contacts in such a way that once the former is energized, both the slow and high speed contacts are opened. The electromagnet that holds the heater bar down also is so interlocked and is deenergized when the machine stop relay in the machine is activated, thereby causing the heater bar to rise.

The 1 output pulse of inverter 101 is ANDed in AND gate 106 with the 0 ouput of AND gate 27 to supply a 0 input pulse to one input terminal of OR gate 109. This is immaterial as far as this part of the operation is concerned because of the 1 input to OR gate 109 from AND gate 108.

Thus, as may be seen from the foregoing, the system illustrated in FIG. 1 is capable of sequentially initiating and terminating various functions of the machine.

In the event of a rod break out or chimney choke, it is desirable for the machine to stop immediately. When either of these events happen, the heater bar will be down and the output of detector 24 will be 0 to 1 depending upon whether there is a cigarette remaining under the detector or not. In either case the output of detector 24 will be constant, not varying between 0 and 1 as it does during normal operation of the machine. The output of AND gate 27 remains at 1, so the input to envelope detector 28 will be continuous 0 to 1. In order for the envelope detector to function normally, i.e. the way in which it functions during normal operation of the machine, it must receive an input that varies between 1 and 0, the envelope detector being reset on each 1 input. As this is not the case, the output at terminal 30 changes from 0 to a continuous 1, while the output at terminal 29 changes from 1 to a continuous 0. As has been noted previously, a change from 1 to 0 output at terminal 29 results in a 1 output pulse from inverter 101, this being supplied to one input terminal of AND gate 106. A 1 input is supplied to the other input terminal of AND gate 106 from AND gate 27. The resultant 1 input to 0R gate 109 from AND gate 106 causes immediate energization of machine stop relay 110. The machine stop relay in the machine is interlocked not only with the high and slow speed contacts and with the electromagnet that holds the heater bar down, as previously noted, but also with the machine plug relay and the machine cork relay. Thus, when the machine stop relay in the machine is activated, the machine plug and cork relays are tripped and remain tripped until the machine is started up again. Consequently, it is necessary after an emergency stop due to a rod break out or chimney choke to reset latches 76 and 82. As previously noted, when either of these events occur, the output of inverter 101 changes from 0 to 1. The other input to AND gate 102 is still 1, since plug latch 72 has not been reset. Consequently there is a 1 input to OR gate 33 from AND gate 26. This provides the necessary 1 output fom OR gate 33 to set latch 36 again. Clock 37, counter 38 and decoder 47 function as previously indicated to provide outputs 50–65 in conductors 48. Shortly after the count has been started the heater bar rises because of deenergization of its electromagnet due to activation of the machine stop relay in the machine. This results in a 0 output from AND gate 27 and, consequently, in AND gates 74–80 being inhibited. On the other hand, the output of inverter 107 becomes 1 and is ANDed in AND gates 113 and 114 with ones of outputs 50–65 that are selected by switches 71 and 72 to provide one outputs from AND gates 113 and 114 that reset latches 76 and 82 respectively. A 1 output from AND gate 108 also will occur, but it is of no consequence because the machine already has been stopped. It will be noted that gates 113 and 114 are enabled by the heater bar rising and the supply of selected outputs from decoder 47 via switches 72 and 73. Consequently it is necessary for the outputs of decoder 47 which are selected to occur after the heater bar has risen. In FIG. 5*a* 150 is the output at terminal 29 during an emergency stop, while 151 in FIG. 5*b* shows the output at AND gate 27 during an emergency stop. The time delay is that inherent in the relays and in the opening of the heater bar contacts after deenergization of the electromagnet that holds it down.

When a pad jam occurs, it is sensed by a microswitch and the manual emergency stop button is automatically pushed. Thus a pad jam is like a manual emergency stop. In a manual emergency stop the machine stop relay in the machine is tripped. This results in the heater bar rising and also results in the two outputs of envelope detector 28 changing state. Under these circumstances, as in an automatic emergency stop, latches 76 and 82 are reset.

Cork splice detector 160, like envelope detector 24, is an infra-red diode and an infra-red sensitive transistor. The infra-red diode of the cork splice detector operates at a considerably higher current than that of the gap detector 24 and provides infra-red pulses that optically "burn" through the cork tip paper except that there is a tape splice. For example, the infra-red diode may provide a 2 microsecond pulse every 30 milliseconds. These one pulses are amplified by an amplifier 161 and are supplied to a cork envelope detector 162 that provides a continuous 1 output as long as it receives 1 inputs in sufficient time to reset it. When tape passes under splice detector 160, the 1 outputs of detector 160 are interrupted and the output of cork envelope detector 162 drops from 1 to 0 triggering a one shot 163. The time period that the output of one shot 163 remains 1 is variable and is preset to correspond to the time taken for the tape to reach inspection drum 20. When the output of one shot 163 changes from 1 to 0 at the end of this period, a differentiator 164 provides a 0 pulse that is inverted by an inverter 165 and supplied to one input terminal or OR gate 92. The resultant 1 input to inspection latch 93 activates inspection relay 94 which activates the machine inspection relay to reject cigarettes on the inspection drum. The 0 output pulse of differentiator 164 triggers another one shot 166. The duration of the resultant 1 output thereof is variable and is preset to correspond to the length of time required to reject all cigarettes carrying tape thereon. When the output of one shot 166 changes from 1 to 0, differentiator 167 provides a 0 output pulse that is inverted by an inverter 168 and supplied to one input terminal of OR gate 98. The resultant 1 output thereof resets latch 93 to deenergize inspection relay 94 and cause the rejection of cigarettes to terminate. In practice a cork splice always is made with the machine stopped and the physical location of the tape always is the same relative to detector 160 within a ½ inch or so. Generally high speed operation is commenced immediately after the cork tip paper is started into the max, so for any given two settings of switches 68 and 69 it is possible to determine the time durations during which one shots 163 and 166 must provide 1 outputs. If these settings are altered, however, it may be necessary to adjust the one shots accordingly to provide longer or shorter 1 outputs.

I claim:

1. In combination with a cigarette machine of the type having the following work stations in the following order: a cigarette making work station at which cigarette paper and tobacco are formed into cigarettes, a plug feeding work station at which plugs are fed into said machine and are arranged end to end with said cigarettes and a cork tip paper feeding work station at which cork tip paper is fed into said machine and wrapped around said plugs and said cigarettes: apparatus for controlling the initiation of various machine functions in timed relationship to the occurrence of an event, said apparatus comprising a clock pulse generator for providing, when activated, a train of clock pulses which occur one after the other in sequential, spaced apart relationship; means responsive to cigarettes being made at said cigarette making work station in a normal fashion for activating said clock pulse generator; means having a plurality of output terminals for translating said train of clock pulses into a plurality of pulse signals that are derivable from individual ones of said output terminals, one such pulse signal being derivable at each of said output terminals and the pulses of different ones of said pulse signals occurring at different points in time; first and second networks, said first network including a first two state device, said first two state device controlling the supply of plugs to said plug feeding work station, said first two state device initiating said supply of plugs when said state thereof changes from one state to a second state thereof and terminating said supply of plugs when said state thereof changes from said second state to said one state thereof, said second network including a second two state device, said second two state device controlling the supply of cork tip paper to said cork tip paper feeding work station, said second two state device initiating said supply of cork tip paper when said state thereof changes from one state to a second state thereof and terminating said supply of cork tip paper when said state thereof changes from said second state to said one state thereof, said first and second networks being connected to at least one of said output terminals and each being responsive to the occurrence of a pulse at said output terminal to which said network is connected for changing the state of said two state device of said network from said one state to said second state thereof.

2. Apparatus according to claim 1 wherein there are at least two of said output terminals, said first network being connected to a first one of said output terminals and said second network being connected to a second of said output terminal, said pulse derivable at said second output terminal occurring at a later point in time than said pulse derivable at said one output terminal.

3. Apparatus according to claim 1 wherein there are a plurality of said output terminals, wherein said first network includes first switch means connected between said first two state device and a plurality of said output terminals for selecting pulses occuring at different ones of said output terminals, and wherein said second network includes second switch means connected between said second two state device and a plurality of said output terminals for selecting pulses occurring at different ones of said output terminals.

4. Apparatus according to claim 3 wherein at least one pulse derivable at at least one of said output terminals to which said second switch means is connected occurs at a later point in time than at least one pulse derivable at at least one of said output terminals to which said first switch means is connected.

5. Apparatus according to claim 4 including means for inhibiting the supply of pulses to said output terminals after a predetermined number of clock pulses have been produced in response to activation of said clock pulse generator by said means responsive to cigarettes being made at said cigarette making work station in a normal fashion.

6. Apparatus according to claim 4 wherein said means responsive to cigarettes being made at said cigarette making work station in a normal fashion comprise detecting means for detecting cigarettes passing from said cigarette making work station to said plug feeding work station.

7. In combination with a cigarette machine of the type having the following work stations arranged in the following order: a cigarette making work station at which cigarette paper and tobacco are formed into cigarettes, a plug feeding work station at which plugs are fed into said machine and are arranged end to end with said cigarettes and a cork tip paper feeding work station at which cork tip paper is fed into said machine and wrapped around said plugs and said cigarettes: apparatus for controlling the initiation and termination of various machine functions in timed relationship to the occurrence of certain events, said apparatus comprising a clock pulse generator for providing, when activated, a train of clock pulses which occur one after the other in sequential, spaced apart relationship; means responsive to cigarettes being made at said cigarette making work station in a normal fashion for activating said clock pulse generator; activatable means for activating said clock pulse generator when said activatable means are activated; means having a plurality of output terminals for translating said train of clock pulses into a plurality of pulse signals that are derivable from individual ones of said output terminals, one such pulse signal being derivable at each of said output terminals and the pulses of different ones of said pulse signals occurring at different points in time; first, second and third and fourth networks, said first and third networks including a first common two state device, said first two state device controlling the supply of plugs to said plug feeding work station, said first two state device initiating said supply of plugs when said state thereof changes from one state to a second state thereof and terminating said supply of plugs when said state thereof changes from said second state to said one state thereof, said second and fourth networks including a second common two state device, said second two state device controlling the supply of cork tip paper to said cork tip paper feeding work station, said second two state device initiating said supply of cork tip paper when said state thereof changes from one state to a second state thereof and terminating said supply of cork tip paper when said state thereof changes from said second state thereof to said one state thereof, said first, second, third and fourth networks being connected to at least one of said output terminals, said two state devices each being responsive to the supply of a pulse thereto via either of said networks associated therewith and derived from a pulse occurring at the output terminal associated with the particular network for changing said state thereof; means responsive to activation of said clock pulse generator by said means responsive to cigarettes being made at said cigarette making work station in a normal fashion for rendering said third and fourth networks incapable of supplying any pulse derived from any pulse at any of said output terminals to which said third and fourth networks are connected to said first and second two state devices respectively and for enabling said first and second networks to supply any pulse derived from any pulse at any of said output terminals to which said first and second networks are connected to said first and second two state devices respectively to change said state of both of said two state devices from said one state to said second state thereof and responsive to activation of said clock pulse generator by activation of said activating means for rendering said first and second networks incapable of supplying any pulse derived from any pulse at any of said output terminals to which said first and second networks are connected to said first and second two state devices respectively and for enabling said third and fourth networks to supply any pulse derived from any pulse at any of said output terminals to which said third and fourth networks are connected to said first and second two state devices respectively to change said state of both of said two state devices from said second state to said one state thereof; and means for inhibiting the supply of pulses to said output terminals after a predetermined number of clock pulses have been produced in response to activation of said clock pulse generator by said means responsive to cigarettes being made at said cigarette making work station in a normal fashion until activation of said clock pulse generator by activation of said activatable means occurs.

8. Apparatus according to claim 7 wherein there are a plurality of said output terminals, said first network being connected to one of said output terminals and said second network being connected to another of said output terminals, said pulse derivable at said another output terminal occurring at a later point in time than said pulse derivable at said one output terminal.

9. Apparatus according to claim 8 wherein said their network is connected to one of said output terminals and said fourth network is connected to another of said output terminals, said pulse derivable at said output terminal to which said fourth network is connected occurring at a later point in time than said pulse derivable from said output terminal to which said third network is connected.

10. Apparatus according to claim 9 wherein there are a plurality of said output terminals and wherein said first, second, third and fourth networks include first, second, third and fourth switching means respectively, said first and third switching means being connected between a plurality of said output terminals and said first two state device for selecting pulses occurring at different ones of said output terminals, said second and fourth switching means being connected between a plurality of said output terminals and said second two state device for selecting pulses occurring at different ones of said output terminals.

11. Apparatus according to claim 10 wherein at least one pulse derivable at at least one of said output terminals to which said second switch means is connected occurs at a later point in time than at least one pulse derivable at at least one of said output terminals to which said first switch means is connected.

12. Apparatus according to claim 11 wherein at least one pulse derivable at at least one of said output terminals to which said fourth switching means is connected occurs at a later point in time than at least one pulse derivable at at least one of said output terminal to which said third switching means is connected.

13. Apparatus according to claim 12 wherein said means responsive to cigarettes being made at said cigarette making work station in a normal fashion comprise detecting means for detecting cigarettes passing from said cigarette making work station to said plug feeding work station.

14. Apparatus according to claim 7 wherein said means responsive to cigarettes being made at said cigarette making work station in a normal fashion for activating said clock pulse generator also is responsive, after said predetermined number of clock pulses have been produced, to cigarettes not being made at said cigarette making work station in a normal fashion for activating said clock pulse generator, the effect of the latter activation on said first, second, third and fourth networks being the same as the effect of activation of said activatable means.

15. Apparatus according to claim 12 wherein said machine includes second activatable means for operating said machine at a higher speed than the speed at which said machine starts up, a fifth network including a fifth switching means and said second activatable means, said fifth switching means being connected between a plurality of said output terminals and said second activatable means, said second activatable means being responsive to the supply of a pulse thereto via said fifth network and derived from a pulse occurring at any of said output terminals to which said fifth network is connected for activating said second activatable means.

16. Apparatus according to claim 15 wherein at least one pulse derivable at at least one of said output terminals to which said fifth switching means is connected occurs at a later point in time than at least one pulse derivable at at least one of the output terminals to which each of said first and third switching means are connected.

17. Apparatus according to claim 16 wherein said machine includes an inspection work station at which substandard cigarettes are rejected, said inspection work station following said cork tip paper feeding work station, said apparatus including a sixth network, said sixth network including a sixth switching means and a third two state device, said third two state device controlling the rejection of cigarettes at said inspection work station, said third two state device initiating rejection of cigarettes when said state thereof changes from one state to a second state thereof and terminating rejection of cigarettes when said state thereof changes from said second state to said one state thereof, said sixth switching means being connected to a plurality of said output terminals, said sixth network including first means for generating a first output pulse of predetermined duration and second means for generating a second output pulse of predetermined duration, said third two state device being responsive to termination of said first output pulse for changing said state thereof from said one state to said second state thereof and responsive to termination of said second output pulse for changing said state thereof from said state to said one state thereof, said first generating means being responsive to the supply of a pulse thereto derived from a pulse occurring at the one of said output terminals to which said third network is connected to generate said first output pulse, said second generating means being responsive to termination of said first output pulse to generate said output pulse.

18. Apparatus according to claim 17 including sensing means for sensing a splice of said cork tip paper, means responsive to the sensing of a splice of said cork tip paper by said sensing means for generating a third output pulse of predetermined duration, third means for generating a fourth output pulse of predetermined duration, said third two state device being responsive to termination of said third output pulse for changing said state thereof from said one state to said second state thereof and responsive to termination of said fourth output pulse for changing said state thereof from said second state to said one state thereof, said third generating means being responsive to termination of said third output pulse for generating said fourth output pulse.

* * * * *